US006791044B2

(12) United States Patent
Van Den Akker et al.

(10) Patent No.: US 6,791,044 B2
(45) Date of Patent: Sep. 14, 2004

(54) SET OF MOVABLE CONTACTS FOR A SWITCH WITH A SET OF FIXED CONTACTS

(75) Inventors: Wouter Franciscus Van Den Akker, Hengelo (NL); Hilbert Gezienus Knol, Hengelo (NL)

(73) Assignee: Holec Holland N.V., Hengelo (NL)

( * ) Notice: Subject to any disclaimer, the term of this patent is extended or adjusted under 35 U.S.C. 154(b) by 0 days.

(21) Appl. No.: 10/312,859

(22) PCT Filed: Jul. 2, 2001

(86) PCT No.: PCT/NL01/00499

§ 371 (c)(1),
(2), (4) Date: Mar. 21, 2003

(87) PCT Pub. No.: WO02/03409

PCT Pub. Date: Jan. 10, 2002

(65) Prior Publication Data

US 2003/0159909 A1 Aug. 28, 2003

(30) Foreign Application Priority Data

Jul. 3, 2000 (NL) ..... 1015584

(51) Int. Cl.[7] ..... H01H 1/30
(52) U.S. Cl. ..... 200/239; 200/247
(58) Field of Search ..... 200/240, 243, 200/245, 246, 247, 250, 252, 257, 260, 275, 282

(56) References Cited

U.S. PATENT DOCUMENTS 1,034,000 A * 7/1912 Durfee ..... 218/4

FOREIGN PATENT DOCUMENTS

| | | | |
|---|---|---|---|
| DE | 32 23 669 | 1/1984 | |
| GB | 763 245 | 12/1956 | |
| JP | 1253132 | * 10/1989 | ..... 200/239 |
| WO | WO 88 02178 | 3/1988 | |

* cited by examiner

*Primary Examiner*—Elvin Enad
*Assistant Examiner*—Lisa Klaus
(74) *Attorney, Agent, or Firm*—Young & Thompson

(57) ABSTRACT

Set of movable contacts for a switch with a set of fixed that comprises at least one pair of a fixed contacts arranged a distance apart, comprising at least one contact element (1), a holder (2) therefor and a resilient element (6). When the switch is in the closed position the contact element (1) is in contact, under mechanical prestress, with the surface of the pair of fixed contacts and bridges the distance between the free end edges thereof facing one another. The holder body (2) has a front and rear face running perpendicularly to the direction of movement thereof and side faces (3) running perpendicularly to said front and rear faces and parallel to the direction of movement. A side face (3) is provided with a longitudinal recess (4) continuing to the end faces (5) of the holder body for accommodating the contact element (1) in such a way that the ends thereof protrude beyond the two end faces (5) of the hodler body (2). The resilient element (6) mechanically prestresses the contact element (1) in the longitudinal reces (4).

25 Claims, 4 Drawing Sheets

SET OF MOVABLE CONTACTS FOR A SWITCH WITH A SET OF FIXED CONTACTS

BACKGROUND OF THE INVENTION

The invention relates to a set of movable contacts for a switch with a set of fixed contacts that comprises at least one pair of fixed contacts arranged a distance apart, comprising at least one contact element, a holder therefor and a resilient element, which contact element, when the switch is in the closed position, is in contact with the surface of the pair of fixed contacts under mechanical prestress producent by the resilient element and bridges the distance between the free end edges thereof facing one another, in which the holder body has a front and rear face running perpendicularly to the direction of movement thereof and side faces running perpendicularly to said front and rear faces and parallel to the direction of movement, in which a side face is provided with a longitudinal recess continuing to the end faces of the holder body for accommodating the contact element in such a way that the ends thereof protrude beyond the two end faces of the holder body.

DESCRIPTION OF THE RELATED ART

A set of movable contacts of this type is disclosed in EP-B 0 281 622.

The known set of movable contacts comprises a number of contact elements in the form of a set of contact rollers. This set of contact rollers comprises an approximately T-shaped piece of iron, a resilient washer with corresponding counterpart and four contact rollers which partially bear on the resilient washers and partially are held together by clips. Between the rollers and the clips there is a spacer which has a thickness which is somewhat less than the thickness of the fixed contacts of the switch. The parts are all provided with an elongated slot to allow the leg of the T-shaped piece of iron to pass through. There is a spiral spring on top of the last resilient washer and the complete device is held together by a retaining plate that is equipped to be pressed downwards over the T-shaped leg and then to be turned through approximately 90°. The mid spacer is furthermore provided with projections which interact with means on a drive disk that can be moved.

The holder of the set of movable contacts for holding the contact elements or rollers in place consists of a large number of separate components, so that a large number of operations are needed when assembling the set of movable contacts.

SUMMARY OF THE INVENTION

The aim of the invention is to provide a set of movable contacts of the type mentioned below with which the number of components is restricted to a minimum and the assembly of which is simpler and with which only a small number of operations is required for assembly. minimum and the assembly of which is simpler and with which only a small number of operations is required for assembly.

Said aim is achieved according to the invention in that the the resilient element is arranged such that it encloses the contact element in interaction with the longitudinal recess in the holder and holds the contact element in the longitudinal recess.

The resilient element serves not only to produce the contact pressure of the contact element on the fixed contact but also serves to enclose the contact element in interaction with the longitudinal recess in the holder. There is thus only a holder in one piece and a resilient element for prestressing and holding in place one or more contact elements.

British Patent Specification 763,245 describes a set of movable contacts for a switch with a set of fixed contacts that comprises at least one pair of fixed contacts arranged a distance apart, comprising at least one contact element, a holder therefor and a resilient element, which contact element, when the switch is in the closed position, is in contact with the surface of the pair of fixed contacts under mechanical prestress produced by the resilient element and bridges the distance between the free end edges thereof facing one another, in which the holder body has a front and rear face running perpendicularly to the direction of movement thereof and side faces running perpendicularly to said front and rear faces and parallel to the direction of movement, in which a side face is provided with a longitudinal recess continuing to the end faces of the holder body for accommodating the contact element in such a way that the ends thereof protrude beyond the two end faces of the holder body.

If the holder is considered separately, the contact elements are pushed out the corresponding recess in the holder body. There is no form-fitting unit of holder body, resilient element and contact elements.

If the holder is made of plastic, the side face of the longitudinal recess closest to the rear face of the holder can be provided with a bearer element. In the absence of the bearer element, which can be in the form of a plate, the contact element exerts high forces on the said side face of the longitudinal recess when the switch is closed, so that said side face can deform and the switching characteristics of the set of movable contacts can be adversely affected. This deformation is counteracted by the bearer element in that the said forces are distributed over a larger surface on the said side face.

In one embodiment of the invention the holder is provided with a second continuous longitudinal recess on the other side face for accommodating a second contact element and the front face of the holder body is provided with a transverse recess, running transversely to the continuous recesses, for accommodating a U-shaped resilient element consisting of two arms and a base joining these, the side walls of the transverse recess being some distance away from the end faces of the holder body and the base of the U bearing on the bottom of the transverse recess and the arms thereof engaging around the outsides of the contact elements.

With this embodiment as well a form-fitting unit with very few components is provided.

Preferably, the bottom of the transverse recess is lower than the side walls of the longitudinal recesses closest to the rear wall of the holder body, the difference in depth not being greater than the thickness of the base of the resilient element.

With this embodiment the base of the resilient element advantageously ensures the distribution of the forces of the contact elements on the side face of the longitudinal recess closest to the rear face of the holder and as it were replaces the abovementioned plate of hard material.

BRIEF DESCRIPTION OF THE DRAWINGS

In an advantageous embodiment of the invention the resilient element is provided with a first set of strips extending from the side edges of the arms of the U-shaped resilient element towards the ends of the first and second contact elements, the free ends of said strips pressing the contact elements into the associated longitudinal recesses under prestress. With this arrangement the pressure is applied at the point where it is needed, specifically close to the ends of the contact elements.

Preferably, the free ends of the strips engage in grooves in the contact elements. By this means the contact elements are secured in the longitudinal direction and a set of movable contacts is obtained that is a force- and form-fitting unit.

Figure 1:
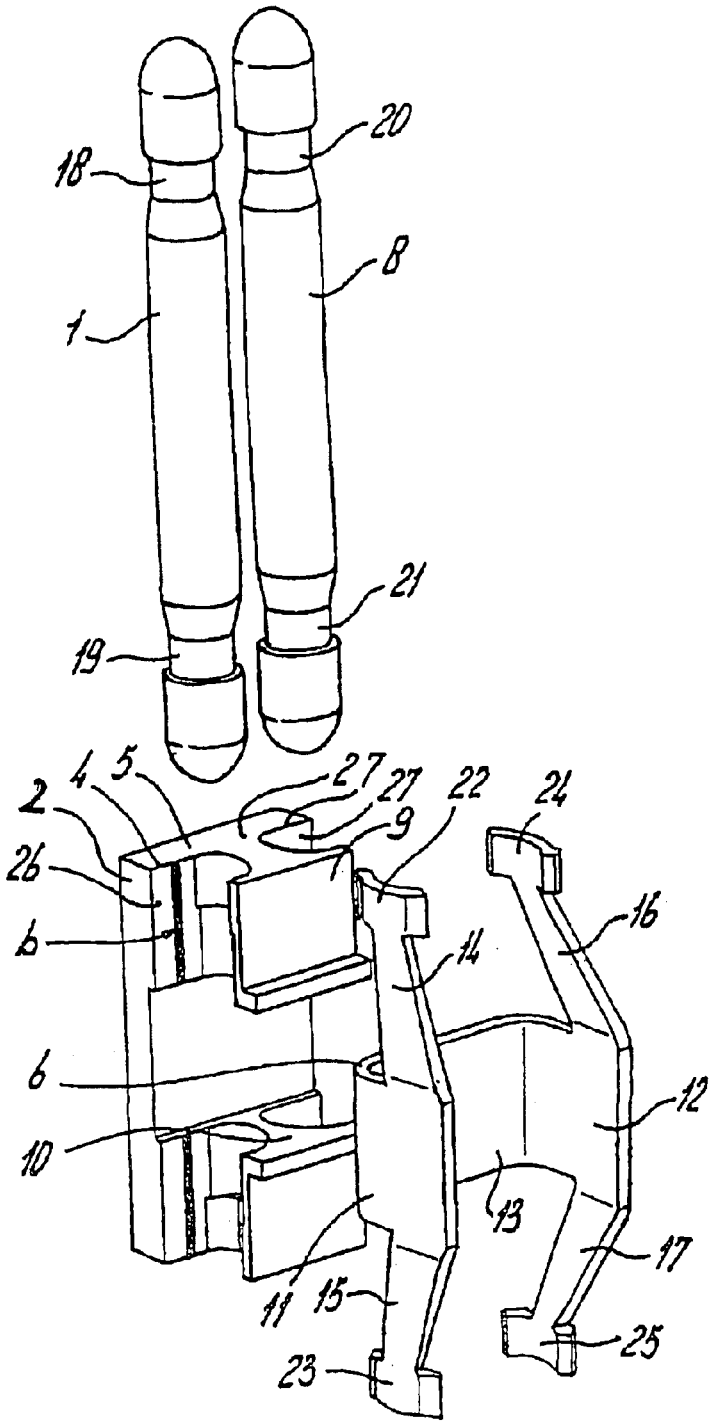

In a further development of the invention, the free ends of the arms of the resilient element extend beyond the strips in order to prestress further contact elements towards one another. With this embodiment only one resilient element can suffice to prestress two or more sets of pairs of contact elements, it being possible to obtain different prestressing forces for the pairs.

Further advantageous embodiments of the set of movable contacts according to the invention are described in the further dependent claims.

The invention also relates to a drive slider for moving the set of movable contacts in order to make contact or to break contact between the fixed contacts of a switch. Advantageous embodiments of the drive slider are described in the further dependent claims.

Figure 2:
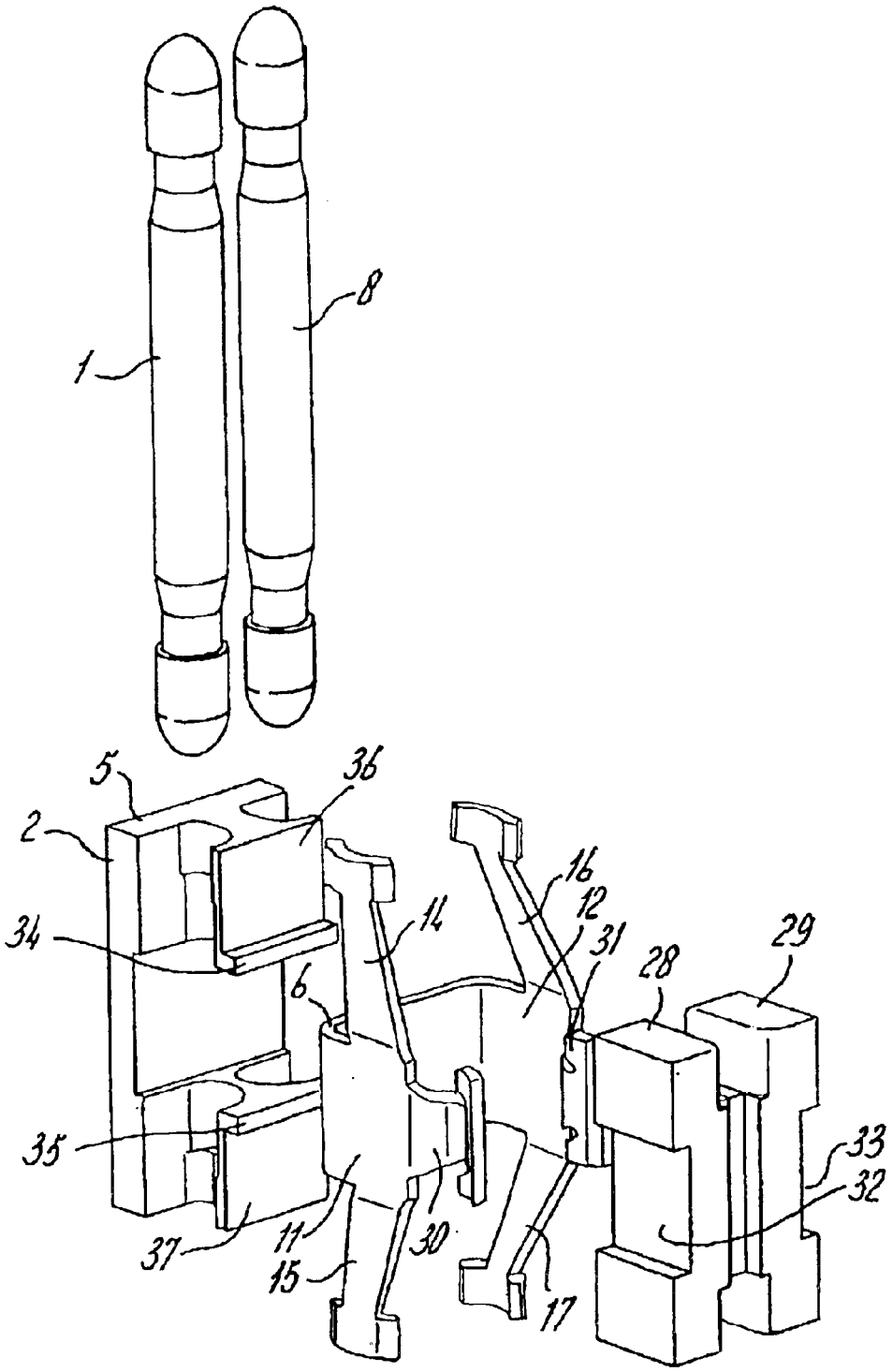
Figure 3:
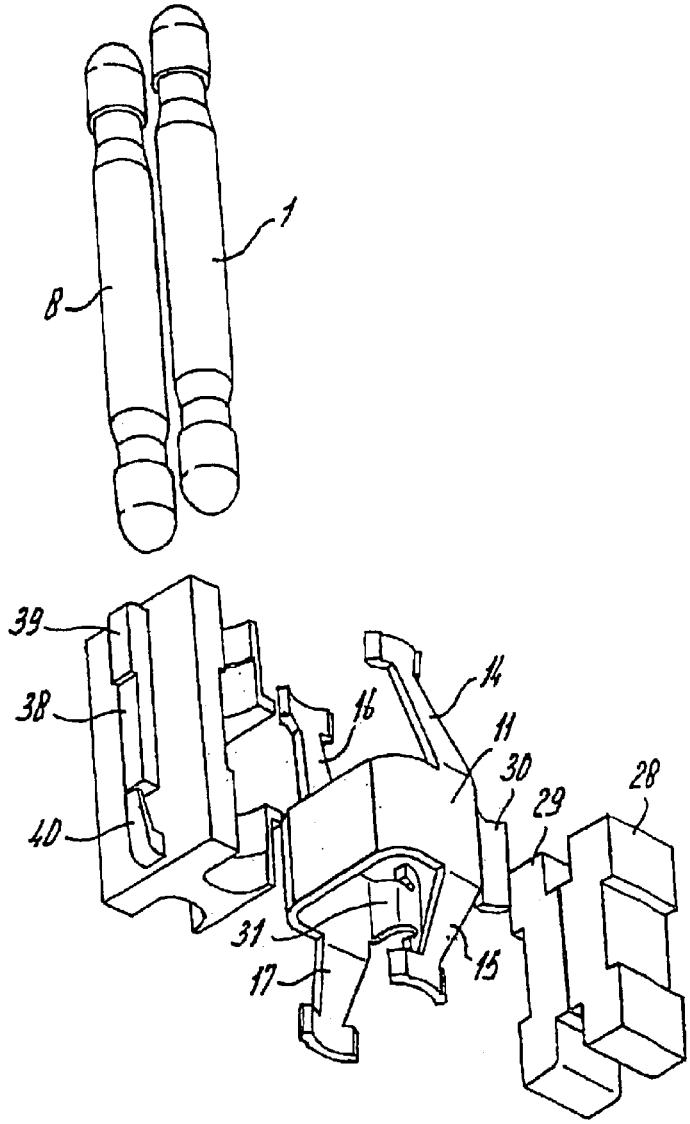

The invention will be explained in more detail below with reference to the drawing. In the drawing:

FIG. 1 shows a perspective view, with the components taken apart, of one embodiment of a set of movable contacts according to the invention with two contact rollers;

FIG. 2 shows a perspective view, with the components taken apart, of a set of movable contacts according to the invention with one pair of contact rollers and one pair of contact blades;

FIG. 3 shows a perspective view of the set of movable contacts according to FIG. 2 viewed from another angle.

Figure 4:
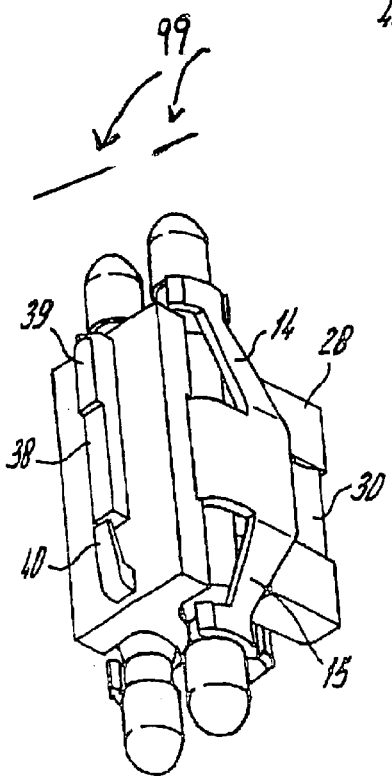
Figure 5:
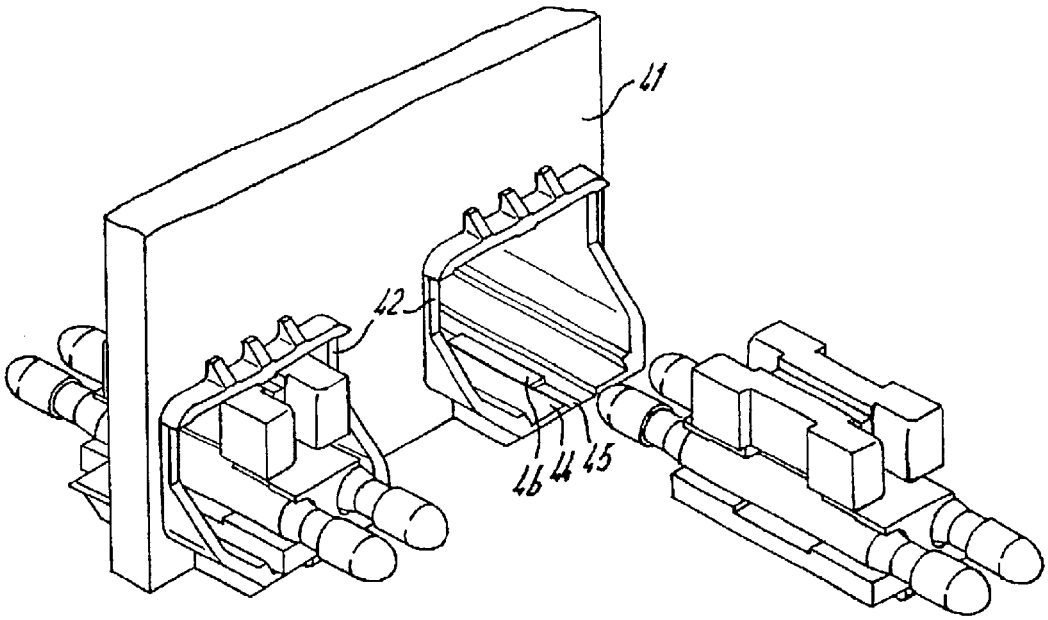
Figure 6:
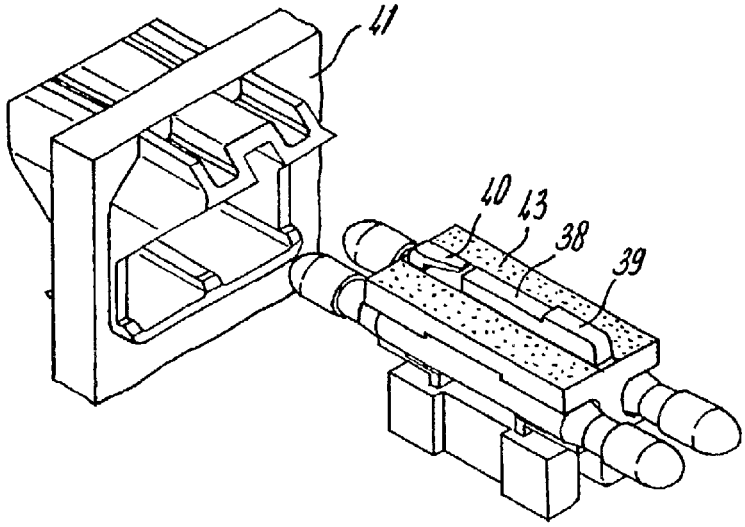

FIG. 4 shows a perspective view of the assembled set of movable contacts according to FIGS. 2 and 3;

FIGS. 5 and 6 show a perspective view of a drive slider according to the invention from different directions.

DESCRIPTION OF THE PREFERRED EMBODIMENTS

The set of movable contacts according to FIG. 1 consists of a contact element 1 and a holder body 2 therefor, which hereinafter is referred to simply as holder. This holder is preferably made from an inexpensive plastic, but can also be made from a different material, such as metal or ceramic. The side face 3 of the holder 2 is provided with a longitudinal recess 4 which extends in the longitudinal direction of the holder 2 as far as the end faces thereof, only one end face of which is visible and is given the reference numeral 5. The longitudinal recess 4 is intended to accommodate the contact element 1, which is enclosed in this longitudinal recess 4 by the resilient element 6. A form-fitting unit is thus produced.

It is pointed out that the contact element 1 is shown as a rolling contact, but contact blades can also be used in a correspondingly shaped longitudinal recess.

The contact element 1 serves for the electrical connection of two fixed contacts of a switch located some distance apart. The fixed contacts 99 are shown generically in FIG. 4. When the switch is closed, in particular in the case of high short-circuit currents, the contact elements of the set of movable contacts exert a high force on the holder, which force is caused by the impingement of the fixed and movable contact elements, the electromagnetic repulsion force on the movable contact element and the frictional force. Since the contact element 1 makes contact with the holder 2 over a relatively small surface area, which surface area is indicated by the track b, the surface pressure in these locations is very high. The consequence of this is that the contact element is able temporarily or even permanently to sink into the plastic, as a result of which the movable contact element temporarily comes to a halt when coming into contact with the fixed contacts and if the deformation of the holder is permanent the instant at which switching takes place will change over time.

Usually the above phenomenon does not have many consequences, but in the case of very high prospective short-circuit currents (around 100 kA) the rise in the current is so rapid that the retardation of the movable contact and the bouncing of the movable contact as a consequence of this are sufficient to cause serious damage to the contact. Preferably, in such circumstances a bearer element, which can be in the form of a steel or ceramic plate, is placed behind the contact or the contacts.

Because steel or ceramic has a much higher modulus of elasticity than a reasonably priced plastic, a steel or ceramic plate behind the contact element is able to distribute the high pressure exerted on the contact element over a much larger plastic surface. This distribution is reflected in appreciably less deformation of the plastic. This reduced deformation ensures that the retardation and the bouncing of the contact element are reduced, so that closing of the switch can be achieved with far fewer problems in the case of high short-circuit currents.

In the embodiment according to FIG. 1 the holder 2 is provided with a second continuous longitudinal recess 7 for accommodating the second contact element 8, that once again is shown as a rolling contact but, of course, can also be a contact blade.

The front face 9 of the holder 2 is provided with a transverse recess 10. This transverse recess 10 runs transversely to the continuous longitudinal recesses 4, 7 and provides a space for accommodating the resilient element 6. This resilient element is U-shaped and has two arms 11, 12 and a base 13 linking these arms. The transverse recess is preferably in the middle between the end faces 5 of the holder 2. The base 13 of the resilient element bears on the bottom of the transverse recess 10 and the arms 11, 12 of the resilient element engage around the contact elements 1, 8 when these have been introduced into the associated recesses 4, 7.

The arms 11, 12 are provided with strips 14, 15 and 16, 17, respectively. The ends 22–25 of the strips 14, 15 and 16, 17 are in contact with the contact elements 1, 8 close to the ends thereof. The distance between the said ends in the not yet assembled position is such that the contact elements are prestressed towards one another.

The contact elements 1, 8 are provided close to their ends with circular grooves 18, 19 and 20, 21, respectively. When the set of movable contacts is in the assembled position these grooves 18–20 accommodate the curved transverse end sections 22, 23 ,24, 25 of the strips 14–17 of the resilient element 6. The contact elements 1, 8 are secured in their position in the recesses 4, 7 by the interaction of the curved transverse section 22–25 and the grooves 18–21. A force- and form-fitting unit of holder, contact elements and resilient element is, as it were, produced.

The holder 2 provides a gap between the ends of the movable contacts. The width of this gap is somewhat less than the thickness of the associated parts of the fixed contacts of the switch.

To assemble the set of movable contacts the resilient element 6 is first placed with its base 13 in the transverse recess 10 in the holder 2 until the base 13 of the resilient element 6 bears on the bottom of the transverse recess 10. The contact elements 1, 8 are then pressed from one end face 5 of the holder 2 into the longitudinal recesses 4, 7 until the transverse parts 22–25 of the strips 14–17 of the resilient element 6 drop into the associated grooves 18–21 of the contact elements 1, 8. The contact elements 1, 8 are then held in this position by the strips 14–17 with the associated curved parts 22–25 at the ends thereof. Preferably, the bottom of the transverse recess 10 is lower in the holder 2 than the side walls 26, 27 of the longitudinal recesses 4, 7 in the holder 2. The difference in depth is preferably no greater than the thickness of the base 13 of the resilient element 6, so that the contact elements 1, 8 are in contact with the base 13 of the resilient element 6 and the forces on the contact elements 1, 8 when the switch is closed are thus essentially taken up by the base 13 of the resilient element 6 and as a result the said forces are distributed over a larger surface of the longitudinal recesses 4, 7 in the holder 2, so that the deformation of the holder is restricted to a minimum.

FIGS. 2, 3 and 4 show a set of movable contacts according to the invention that is suitable, for example, for a switch with stepped contact bars, such as is disclosed, for example, in EP-B 0 281 622. As a result of this stepped construction the stroke of the movable contacts can be smaller, as a result of which the entire switch becomes smaller. The contact elements 1, 8, which in relation to their function are also referred to as arcing contacts, first make contact with those parts of the fixed contacts that are a greater distance apart. The set of movable contacts also comprises a second pair of contact elements 28, 29, which in the embodiments in FIGS. 2, 3 and 4 are constructed as contact blades. These contact blades 28, 29 remain free of the fixed contacts during the first part of the switch closing movement, until they make contact with those parts of the fixed contacts that are closer together. These contact elements 28, 29 are also referred to as main contact elements because these carry the major proportion of the current when the switch is in the closed position.

The holder 2, the contact elements 1, 8 and that part of the resilient element 6 that interacts with the holder 2 and the contact elements 1, 8 have the same construction as the corresponding components of the set of movable contacts according to FIG. 1. Therefore, a description of that part that corresponds to the set of movable contacts according to FIG. 1 can be dispensed with for FIGS. 2, 3 and 4.

The arms 11, 12 of the U-shaped resilient element 6 are provided with extended arm sections 30, 31 beyond the strips 14–17, which arm sections 30, 31 are intended to push the second pair of contact elements 28, 29 towards one another.

FIG. 4 shows the assembled set of movable contacts according to the invention, the strips 14–17 running transversely to the arms 11, 12 of the resilient element 6 prestressing the first contact elements 1, 8 into the associated recesses in the holder 5, whilst the extended sections 30, 31 of the arms 11, 12 of the resilient element 6 prestress the second contact elements 28, 29 towards one another. In this assembled position gaps remain at the ends of the first contact elements 1, 8, which gaps are smaller than the thickness of the associated part of the fixed contacts in such a way that these parts of the fixed contacts are accommodated by the ends of the first contact elements 1, 8 under prestress. Gaps also remain at the ends of the second contact elements 28, 29, which gaps are somewhat smaller than the thickness of the associated part of the fixed contacts of the switch. The extended arm sections 30, 31 are provided with end parts running transversely which fit in the recesses 32 and 33 in the second contact elements 28, 29.

The rear faces of the contact elements 28, 29 of the second pair are in contact with ridges 34 and 35 on the front faces 36, 37 of the holder 2. The interval between the points in time at which the first pair of contact elements 1, 8 and the second pair of contact elements 28, 29 make contact with the fixed contacts of the switch can be accurately determined by sizing the height of these ridges 34 and 35.

The second pair of contact elements 28, 29 is constructed as a set of contact blades, but it is also possible to construct these as rolling contacts. These rolling contacts can then be held in place and prestressed in a corresponding manner by the resilient element 6 and the holder 2, as in the manner described for the first pair of contact elements 1, 8, for example by a second pair of strips which run transversely to the arms 11, 12 of the resilient element 6 and a second set of recesses in the holder 2 for accommodating the second pair of contact elements. This method of enclosing and prestressing can also be used for further contact blade elements.

In FIGS. 3 and 4 it can be seen that the holder 2 is provided with a ridge 38. This ridge is provided at one end with a projection 39 and a snap-fit element 40. This projection and snap-fit element extend above the surface of the ridge 38. It is also possible to arrange a snap-fit element at both ends of the ridge. This projection and snap-fit element (s) serve for positioning and holding the holder 2 in a drive slider.

It is also possible to provide ridge 38 with an elevation which interacts with a projection and a snap-fit element in a groove 45 of a hole 42 in a drive slider 41. Here again the projection in groove 45 can be replaced by a second snap-fit element. Snap-fit element(s) and projection again serve for positioning and fixing the holder.

According to FIG. 5 the drive slider 41 is provided with holes 42 for accommodating sets of movable contacts according to the invention. The drive slider shown in FIG. 6 corresponds to the drive slider 41 in FIG. 5 viewed from below.

For reasons of clarity, the sets of movable contacts are shown without resilient element.

If the drive slider is not sufficiently thick, the surface of the wall of the hole 42 towards which the rear face 43 of the set of movable contacts faces is extended, preferably by an extension 44 in both directions of the drive slider 41. The surface of the extension 44 corresponds to or is wider than the surface of the rear face 43 of the set of movable contacts. The extension 44 is provided with a groove 45 for accommodating the ridge 38 with the projection 39 and the snap-fit element 40. The raised part 46 of the groove 45 fits between the projection 39 and the snap-fit element 40.

Preferably the depth of the groove 45 in the extension 44 of the wall of the hole 42 is greater than the height of the ridge 38 and the associated projection 39 and snap-fit element(s) 40. Preferably, groove 45 is also wider than the width of the ridge 48 and the associated projection 39 and snap-fit element(s) 40.

The resilient element of the set of movable contacts has the following important characteristics:

The resilient element in combination with the holder and the movable contacts forms a force- and form-fitting unit.

The resilient element exerts the contact force both on the first pair and on any further pairs of contact elements, it being possible in a simple manner to allow the contact pressures of the various pairs to differ from one another. This is important especially when the functions of the pairs differ from one another, for example arcing pair and main pair. As a result of the construction of the resilient element freedom in sizing can be obtained for the pairs with one element.

It is important that the resilient element engages via the strips running transversely to the arms of the resilient element on the ends of the first pair of contact elements. This can be achieved in the same way for the subsequent pairs of contact elements. Specifically from the aspects of tolerance engineering, ease of assembly and functionality, the holder is mounted in the drive slider with relatively great freedom of movement. In order then still to guarantee a very rapid build-up of the contact force without impeding the self-seeking freedom of the contacts it is important that the spring engages on the ends of the first pair of contact elements.

Shaping of the spring is so chosen that the spring at the same time assumes the function of distributing the forces of the contact elements on the holder over a large surface area. This not only saves an additional component, but mainly has advantages as far as ease of assembly is concerned.

Assembly of the set of movable contacts in the drive slider is facilitated as much as possible in that the holder can be mounted in the drive slider such that it can be slid in, which holder is secured by one or more plastic snap-fit element(s) integrated in the holder or drive slider.

The drive slider has the following important characteristics:

A large surface is provided for the rear of the holder. This large surface ensures as optimum as possible a transfer of the driving energy from the slider to the holder, whilst the movements perpendicular to the direction of movement of the slider are impeded as little as possible. These factors are important because good closing on high short-circuit currents requires a very rapid rise in the net contact pressure. One way of achieving this is providing a free self-seeking set of movable contacts that closes on the fixed contacts without discernible delay.

The ridge on the rear of the holder and the recess in the associated surface of the hole in the drive slider then together ensure correct positioning and freedom of the set of movable contacts.

The recess in the extension of the slider is so deep that the ridge on the holder can never transfer drive energy from the slider to the holder. Specifically, the large extensions in the hole of the drive slider are already present for this purpose. If the ridge were to transfer energy the pressure of the slider on the ridge would become so high that the freedom of movement of the holder perpendicular to the direction of movement of the slider would be impeded. Moreover, the holder could then deform, as a result of which a wedge construction is obtained, which results in the net contact pressure becoming lower.

The freedom of movement and the stress on the set of contacts in the direction of assembly is very low and therefore securing of the set of movable contacts is arranged in the direction of assembly.

The width of the groove in the extension of the hole 42 in the drive slider 41 in combination with the width of the ridge 38 on the rear of the holder 2 then determine the freedom of movement in the remaining directions. The width of the groove can be wider than the width of the ridge on the holder.

What is claimed is:

1. Set of movable contacts for a switch with a set of fixed contacts that comprises at least one pair of fixed contacts arranged a distance apart, comprising at least one contact element (1), a holder body (2) therefor and a resilient element (6), which contact element (1), when the switch is in the closed position, is in contact with a surface of the pair of fixed contacts under mechanical prestress produced by the resilient element (6) and bridges a distance between the free end edges thereof facing one another, in which the holder body (2) has a front and rear face running perpendicularly to the direction of movement thereof and side faces (3) running perpendicularly to said front and rear faces and parallel to the direction of movement, in which a side face (3) is provided with a longitudinal recess (4) continuing to the end faces (5) of the holder body for accommodating the contact element (1) in such a way that the ends thereof protrude beyond the two end faces (5) of the holder body (2), characterised in that the resilient element (6) is arranged such that it encloses the contact element (1) in interaction with the longitudinal recess (4) in the holder (2) and holds the contact element in the longitudinal recess.

2. Set of movable contacts according to claim 1, characterised in that the holder body (2) is provided with a second continuous longitudinal recess (7) on another side face for accommodating a second contact element (8) and in that the front face (9) of the holder body (2) is provided with a transverse recess (10), running transversely to the continuous recesses (4, 7), for accommodating a U-shaped resilient element (6) consisting of two arms (11, 12) and a base (13) joining these, the side walls of the transverse recess being some distance away from the end faces (5) of the holder body (2) and the base (13) of a U bearing on the bottom of the transverse recess (10) and the arms (11, 12) thereof engaging around the outsides of the contact elements (1, 8).

3. Set of movable contacts according to claim 2, characterised in that the bottom of the transverse recess (10) is lower than the side walls (26, 27) of the longitudinal recesses (4, 7) closest to the rear wall (43) of the holder body (2), and in that the difference in depth is not greater than the thickness of the base (13) of the resilient element (6).

4. Set of movable contacts according to claim 2, characterised in that the resilient element (6) is provided with a first set of strips (14–17) extending from the side edges of the arms (11, 12) of the U-shaped resilient element (6) towards the ends of the first and second contact elements, the free ends of said strips (14–17) pressing the contact elements (1, 8) into the associated longitudinal recesses (4, 7) under prestress.

5. Set of movable contacts according to claim 4, characterised in that the free ends (22–25) of the strips (14–17) engage in grooves (18–21) in the contact elements (1, 8).

6. Resilient element suitable for use in a set of movable contacts according to claim 5, having a U-shape, consisting of two arms (11,12) and a base (13) joining these, the side walls of the transverse recess being some distance away from the end faces (5) of the holder body (2) and the base (13) of the U bearing on the bottom of the transverse recess (10) and the arms (11,12) thereof engaging around the outsides of the contact elements (1,8).

7. Holder suitable for use in a set of movable contacts according to claim 5, wherein the holder body (2) is provided with two parallel continuous longitudinal recesses (4,7) for accommodating two contact elements (1,8) in spaced relationship and wherein the front face (9) of the holder body (2) is provided with the transverse recess (10) running transversely to the continuous recesses (4,9).

8. Set of movable contacts according to claim 4, characterised in that the free ends of the arms (11, 12) of the resilient element (6) extend beyond the strips (14 -17) in order to prestress further contact elements towards one another.

9. Set of movable contacts according to claim 8, characterised in that the further contact elements are accommodated in associated longitudinal recesses in the side faces of the holder and in that the resilient element is provided at the extended free ends with further strips extending from the side edges of the extended arms of the resilient element towards the ends of the further contact elements, the free ends of which strips prestress the further contact elements towards one another.

10. Set of movable contacts according to claim 9, characterised in that recesses are made in the further contact elements for accommodating the free ends of the associated strips.

11. Set of movable contacts according to claim 8, characterised in that the third and fourth (28, 29) of the further contact elements are a contact blade, are provided with a recess (32, 33) for accommodating an end (30, 31) of the extended arms (11, 12) and bear on supporting surfaces (34, 35) at a front (36, 37) of the holder body (2).

12. Set of movable contacts according to claim 8, characterised in that the third and fourth contact elements (28, 29) have recesses in the surfaces of the free ends facing one another in order, when the switch is in the closed position, to accommodate the corresponding contact parts of the fixed contacts of the switch such that they are clamped.

13. Set of movable contacts according to claim 1, characterised in that a ridge (38) is moulded on to a rear face (43) of the holder.

14. Set of movable contacts according to claim 13, characterised in that a projection (39) is arranged at one end of the ridge (38) and a snap-fit element (40) is arranged at another end thereof, projection and snap-fit element extending beyond the surface of the ridge facing away from the rear face (43) of the holder body (2).

15. Set of movable contacts according to claim 13, characterised in that a snap-fit element is arranged at both ends of the ridge, the snap-fit elements extending beyond the surface of the ridge facing away from the rear face (43) of the holder body (2).

16. Set of movable contacts according to claim 1, characterised in that the holder body (2) is made of plastic and that side face (26, 27) of the longitudinal recess (4) closest to the rear face (43) of the holder body (2) is provided with a bearer element made of a material for distributing the forces produced by the associated contact element (1).

17. Set of movable contacts according to claim 16, characterised in that the material is metal.

18. Set of movable contacts according to claim 16, characterised in that the material is ceramic.

19. Drive slider provided with one or more holes (42) for accommodating the mid section of one or more sets of movable contacts according to claim 1, characterised in that the surface of a wall of the hole (42) towards which a rear face (43) of the holder body of the set of contacts faces is extended by an extension (44) in a direction of the ends of the set of contacts.

20. Drive slider according to claim 19, characterised in that the wall of the hole (42) towards which the rear face (43) of the holder body of the set of contacts faces is provided with a groove (45) for accommodating a ridge (38) on the rear face (43) of the holder body (2) of the set of contacts.

21. Drive slider according to claim 20, characterised in that a projection is arranged at the one end of the groove (45) and a snap-fit element is arranged at the other end thereof, which projection and snap-fit element are able to interact with an elevation on the ridge (38) on the rear face (43) of the holder body (2) of the set of contacts.

22. Drive slider according to claim 20, characterised in that snap-fit elements are arranged at both ends of the groove (45), which snap-fit elements are able to interact with an elevation on the ridge (38) on the rear face (43) of the holder body (2) of the set of contacts.

23. Drive slider according to claim 20, characterised in that the bottom of the groove (45) in the wall of the hole (42) is provided with a positioning elevation (46) for positioning the holder body (2) in combination with the ridge (38) and the associated projection (39) and/or snap-fit element(s) (40).

24. Drive slider according to claim 20, characterised in that the depth of the groove (45) in the wall of the hole (42) is so great that the rear face (43) of the holder body (2) is in direct contact with the wall (44) of the hole (42).

25. Drive slider according to claim 20, characterised in that the groove (45) is wider than the ridge (38) on the rear face (43) of the holder body (2) of the set of contacts.

* * * * *